US005573693A

United States Patent [19]

Lorence et al.

[11] Patent Number: 5,573,693

[45] Date of Patent: Nov. 12, 1996

[54] FOOD TRAYS AND THE LIKE HAVING PRESS-APPLIED COATINGS

[75] Inventors: Matthew W. Lorence; David H. Scherpf; Brian D. Hopkins, all of Omaha, Nebr.; William E. Archibald, Fullerton, Calif.

[73] Assignee: Conagra, Inc., Omaha, Nebr.

[21] Appl. No.: 92,268

[22] Filed: Jul. 15, 1993

Related U.S. Application Data

[63] Continuation-in-part of Ser. No. 889,461, May 27, 1992, abandoned.

[51] Int. Cl.[6] ..... H05B 6/80

[52] U.S. Cl. ..... 219/730; 219/731; 219/734; 426/103; 426/107; 426/113; 426/234; 428/323; 99/DIG. 14

[58] Field of Search ..... 219/730, 725, 219/731, 734; 99/DIG. 14; 426/107, 103, 113, 234, 243; 428/323, 34.3, 425.1, 35.7, 287, 192, 233, 142; 260/29.3, 28.5, 848; 161/250; 117/76, 84, 148, 132

[56] References Cited

U.S. PATENT DOCUMENTS

| | | | |
|---|---|---|---|
| 1,633,787 | 6/1927 | Kress | 428/121 |
| 3,349,985 | 10/1967 | Salway | 229/14 |
| 3,415,662 | 12/1968 | Koger et al. | 426/124 |
| 3,495,758 | 2/1970 | Wienecke, Jr. | 229/43 |
| 3,661,697 | 5/1972 | Kimmel et al. | 161/250 |
| 3,730,338 | 5/1973 | Chesky | 206/459.5 |
| 3,759,720 | 9/1973 | Young | 426/124 |
| 3,843,576 | 10/1974 | Parkinson | 260/29.3 |
| 3,851,574 | 12/1974 | Katz et al. | 426/107 |
| 3,868,017 | 2/1975 | Carveth | 206/491 |
| 3,924,013 | 12/1975 | Kane | 426/523 |
| 4,026,458 | 5/1977 | Morris et al. | 426/524 |
| 4,147,836 | 4/1979 | Middleton et al. | 428/35 |
| 4,252,268 | 2/1981 | Haire | 229/120 |
| 4,257,530 | 3/1981 | Faller | 220/469 |
| 4,343,858 | 8/1992 | Thompson | 428/342 |
| 4,351,997 | 9/1982 | Mattisson et al. | 219/730 |
| 4,355,721 | 10/1982 | Knott, II et al. | 206/524.2 |
| 4,391,833 | 7/1983 | Self et al. | 426/523 |
| 4,418,119 | 11/1983 | Morrow et al. | 428/342 |
| 4,421,825 | 12/1983 | Seiter | 428/332 |
| 4,429,216 | 1/1984 | Brigham | 428/337 |
| 4,456,164 | 6/1984 | Foster et al. | 229/125.35 |
| 4,463,029 | 7/1984 | Nishijima et al. | 427/209 |
| 4,469,258 | 9/1984 | Wright et al. | 229/123.1 |
| 4,505,961 | 3/1985 | Lu | 428/36.5 |
| 4,505,962 | 3/1985 | Lu | 428/36.5 |
| 4,559,266 | 12/1985 | Misasa et al. | 428/341 |
| 4,592,914 | 6/1986 | Kuchenbecker | 426/107 |
| 4,595,611 | 6/1986 | Quick et al. | 428/34.2 |
| 4,757,940 | 7/1988 | Quick et al. | 229/3.5 R |
| 4,794,027 | 12/1988 | Hering | 428/68 |
| 4,821,884 | 4/1989 | Griffin et al. | 206/557 |
| 4,834,247 | 5/1989 | Oshima et al. | 426/107 |
| 4,880,112 | 11/1989 | Conrad | 206/216 |
| 4,889,239 | 12/1989 | Sandish et al. | 206/562 |
| 4,890,439 | 1/1990 | Smart et al. | 53/410 |

(List continued on next page.)

OTHER PUBLICATIONS

Document 1 consists of a confidentiality agreement between ConAgra, Inc. and Westvaco wherein Westvaco disclosed that it had formulated a PET–less coating for flat tray lids. Document 2 consists of Mr. Matthew Lorence's labnotes reflecting his conception of a press–applied coating for formed food trays.

*Wiley Encyclopedia Of Packaging Technology,* Bakker (Editor), J. Wiley & Sons (1986).

*Primary Examiner*—Tu Hoang

*Attorney, Agent, or Firm*—Pretty, Schroeder, Brueggemann & Clark

[57] ABSTRACT

A container for food includes a paper-based substrate, and at least one grease and moisture resistant coating applied in liquid form to the paper-based substrate. The liquid coating is preferably formed from an aqueous-based dispersion of acrylic-based material. The liquid coating remains resistant to grease and moisture issuing from food at temperatures in the range of about −20° F. to 425° F.

28 Claims, 4 Drawing Sheets

U.S. PATENT DOCUMENTS

| | | | |
|---|---|---|---|
| 4,900,594 | 2/1990 | Quick et al. | 428/34.2 |
| 4,903,842 | 2/1990 | Tokuda et al. | 229/123.1 |
| 4,904,836 | 2/1990 | Turpin et al. | 219/730 |
| 4,925,035 | 5/1990 | Hunninghaus | 220/462 |
| 4,935,276 | 6/1990 | Pawlowski et al. | 428/35.7 |
| 4,935,282 | 6/1990 | Pawlowski et al. | 428/121 |
| 4,939,332 | 7/1990 | Hahn | 219/730 |
| 4,946,372 | 8/1990 | Avni | 428/325 |
| 4,955,530 | 9/1990 | Rigby et al. | 229/123.2 |
| 4,962,849 | 10/1990 | Anderson | 206/45.24 |
| 5,002,826 | 3/1991 | Pollart et al. | 428/323 |
| 5,002,833 | 3/1991 | Kinsey, Jr. et al. | 428/475.8 |
| 5,011,006 | 4/1991 | Anderson | 206/45.24 |
| 5,090,615 | 2/1992 | Hopkins et al. | 229/125.35 |

FOOD TRAYS AND THE LIKE HAVING PRESS-APPLIED COATINGS

CROSS-REFERENCE TO RELATED APPLICATIONS

This application is a continuation-in-part of copending patent application Ser. No. 07/889,461, filed on May 27, 1992, now abandoned and a continuation-in-part of International Application PCT/US93/4987, filed May 26, 1993, which designated the United States of America, the contents of which are hereby incorporated by reference.

BACKGROUND OF THE INVENTION

The present invention relates generally to the field of paper-based food containers, and more particularly to frozen food trays, ice cream containers, gable top containers, beverage cups, food cartons and the like having press-applied coatings thereon.

Paper-based food containers have customarily been formed from paperboard extruded with wax or a polymer layer, such as polyethylene, polypropylene or polyethylene terephthalate (PET). Additional coatings have been developed for, among other things, rendering the food cartons resistant to grease and moisture and for preventing ink-printed graphic designs from leaching into the food contained therein.

For example, U.S. Pat. No. 4,595,611 to Quick et al. discloses an ink-printed ovenable food container comprising a layer of ink printed on the food contact side of a paperboard substrate and a layer of polyester resin atop the ink for preventing the ink from migrating into the food. U.S. Pat. No. 4,463,029 to Nishijima et al. describes a baking tray sheet which is heat resistant and may be used in both microwave and conventional ovens. The baking tray sheet has a base of paper or cardboard coated with a layer composed of polyvinyl alcohol and/or starch and a water-resisting agent. Atop this layer is an additional coating of silicone. U.S. Pat. No. 4,469,258 to Wright et al. discloses a tray formed from paperboard or plastic. The paperboard tray may have extruded thereon PET, polypropylene, acrylics or hot melt materials to render the tray resistant to water, oils and fats. U.S. Pat. No. 4,418,119 to Morrow et al. discloses an ovenable board formed from paper or paperboard and coated with a layer of polyvinyl alcohol and a silicone. U.S. Pat. No. 4,456,164 to Foster et al. describes an ovenable container having a base of molded pulp or pressed paperboard having a layer of polymeric material bonded thereto in a secondary process.

Due to the relative expense of polymeric material, polymer-extruded paperboard food containers as described above are undesirably costly to fabricate. Additionally, because of the polymers extruded onto the paper material, these food cartons are not readily recyclable.

It is, therefore, an object of the present invention to provide a food container having a paperboard base with liquid coatings press-applied thereon.

It is another object of the present invention to provide a food container having a paperboard base with coatings resistant to grease and/or moisture issuing from foods.

It is still another object of the present invention to provide a food container having a paperboard base with coatings that remain resistant to grease and/or moisture through a broad range of temperatures.

It is yet still another object of the present invention to provide a food container that may be capable of being recycled.

SUMMARY OF THE INVENTION

According to a first aspect of the present invention, a package for food having a moisture content of at least 75% includes a paper-based substrate, and at least one grease and/or moisture resistant, liquid coating press-applied to said paper-based substrate, all of said coatings comprising aqueous-based dispersions including acrylic-based material to define a food-contacting surface of the package.

According to a second aspect of the present invention, a container for food includes a paper-based substrate, and at least one grease and/or moisture resistant coating applied in liquid form to said paper-based substrate to define a food-contacting surface of the container.

According to a third aspect of the present invention, a process of forming a food container includes the following steps: providing a paper-based substrate; applying at least one grease and moisture resistant coating in liquid form to the paper-based substrate to define a food-contacting surface of the container; and drying the at least one liquid coating on the paper-based substrate.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

The present invention is applicable to a variety of food containers or packages, including ovenable frozen food trays, ice cream containers, hinged-lid food trays, gable top containers, food cartons and beverage cups.

Figure 1:
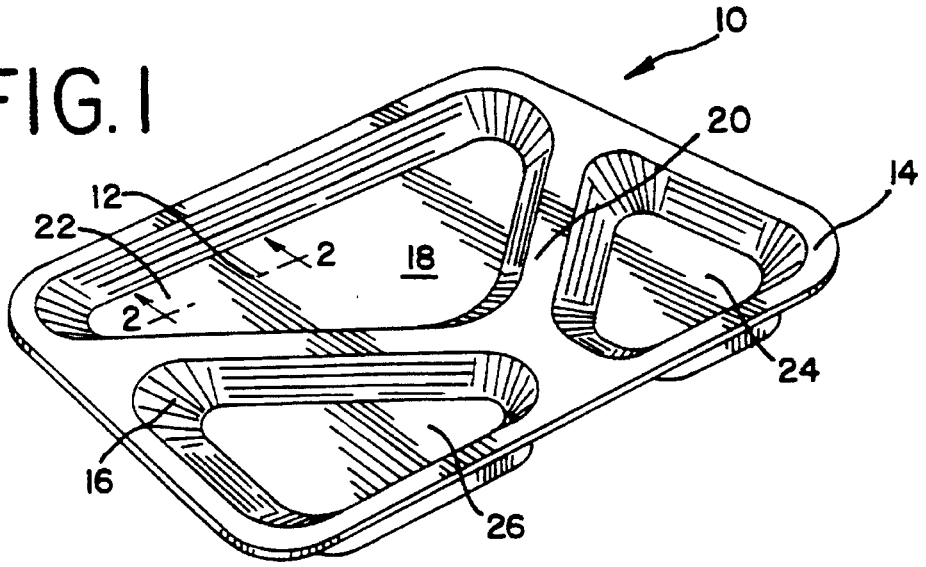
FIG. 1 is a perspective view of a frozen food tray which incorporates a presently preferred embodiment of this invention.

As shown in FIG. 1, a frozen food tray 10 is shaped to define a recess 12, a raised perimeter edge 14 and an inner wall 16. The recess 12, the inner wall 16 and the raised perimeter edge 14 define a food-contacting surface 18.

The frozen food tray 10 may define a raised internal ridge dividing the recess 12 into a plurality of compartments. Preferably, however, the frozen food tray 10 defines a Y-shaped raised internal ridge 20. The Y-shaped raised internal ridge 20 divides the recess 12 into three compartments 22, 24, 26 and rigidifies the frozen food tray 10. Each of the three compartments 22, 24, 26 typically contains a food (not shown) when the frozen food tray 10 is packaged.

Figure 2:
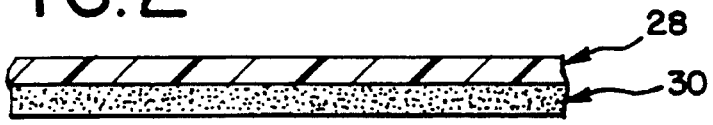
FIG. 2 is a cross-sectional view taken along line 2—2 of FIG. 1.

As shown in FIG. 2, the frozen food tray 10 is preferably formed from a grease and/or moisture resistant, liquid coating 28 press-applied to a paper-based substrate 30. Also, the liquid coating 28 may be applied to specific areas of the substrate 30. The paper-based substrate 30 may initially have a clay coating applied to the food-contact side thereof to prevent the liquid coating 28 from soaking into the substrate 30. The liquid coating 28 preferably defines the food-contacting surface 18 of the frozen food tray 10.

Generally, the liquid coating 28 is a thermoplastic or a thermo-setting material. Preferably, the liquid coating 28 comprises ethylene vinyl acetate (EVA), aminos (including hydrolyzed proteins), fluroplastics (including Teflon), epoxy, polyamides (including nylon), phenolics, vinyl, non-extruded polyesters (including polycarbonates and alkalyds), polyethylene terephthalate, polybutylene terephthalate, unsaturated polyesters, epoxy-esters, urethanes, styrene acrylics, polyolefins (including polypropylenes, polybutylenes, ionomers and polyethylenes of differing densities), natural polymers, cellulosics (including cellophane and Rayon), nitrocellulose, polyimides, styrenics (including polystyrene), silicones, polysulfones or polymethylpentene. Most preferably, however, the liquid coating 28 is acrylic-based. Preferably, the coating 28 comprises an aqueous-based dispersion. Alternately, however, the coating 28 may be a solvent-based dispersion or solution.

Coatings formed from aqueous-based dispersions are preferred because they are less toxic than coatings formed from solvent-based dispersions. Also, since the filtration equipment required to prevent the solvents used to form the solvent-based coatings from entering into the environment are not necessary for coatings formed from aqueous-based dispersions, the use of aqueous-based coatings may result in lowered food container production costs.

The frozen food tray 10 is preferably designed for food having a moisture content of at least 75% and for use at temperatures in the range of −10° F. to 425° F. The liquid coating 28 may remain grease and/or moisture resistant through a broad range of temperatures, including frozen temperatures (i.e., the range of temperatures at which foods become frozen), refrigeration temperatures (i.e., approximately 30° F. to 50° F.), shelf-stable temperatures (i.e., approximately 30° F. to 212° F.) and elevated temperatures in the range of 200° F. to 425° F.

The coating 28 has a dry basis weight preferably in the range of about 0.1 to 5 lbs./1000 $ft^2$. More preferably, however, the coating 28 has a dry basis weight in the range of about 1 to 2 lbs./1000 $ft^2$. The dry basis weight of a coating is the coating's weight after it is applied to a base material and is in a dried state.

The moisture content of food may be derived by: weighing the food; drying the food until the moisture therein has evaporated; weighing the dried food; and comparing the initial weight of the food to the dried weight. The ratio of the difference between the initial weight and the dried weight to the initial weight, expressed in percentage form, equals the moisture content of the food.

Figure 3:
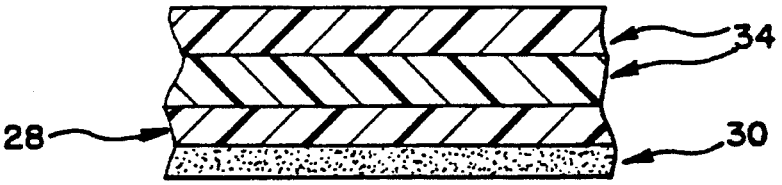
FIG. 3 is a cross-sectional view taken along line 2—2 of FIG. 1 showing an alternate embodiment of this invention.
Figure 13:
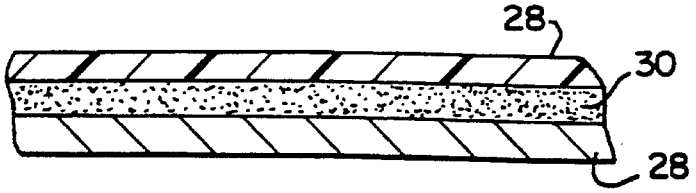
FIG. 13 is a cross-sectional view taken along line 2—2 of FIG. 1 showing an alternate embodiment of this invention.

In an alternate embodiment, as shown in FIG. 3, the paper-based substrate 30 may have, on one side thereof, multiple coatings 34 layered atop the coating 28. The multiple coatings 34 may comprise additional grease and/or moisture resistant coatings 28 and/or other suitable coatings with specific barrier or sealing characteristics. The barrier and sealing characteristics may include enhanced sealability to lidding material and/or water vapor, moisture, or grease resistance. Additionally, as shown in FIG. 13, the substrate 30 may be coated on both sides with the coating 28.

Figure 4:
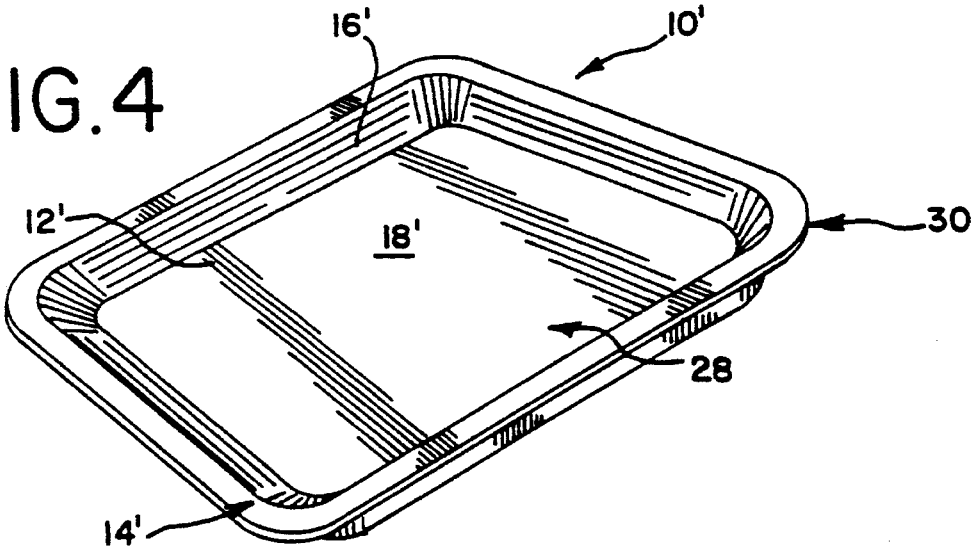
FIG. 4 is a perspective view of an alternate embodiment of the frozen food tray of this invention.

As shown in FIG. 4, an alternate embodiment of a frozen food tray 10' comprises a paper-based substrate 30 coated as described above and shaped to define a recess 12', a raised perimeter edge 14' and an inner wall 16'. The recess 12', the inner wall 16' and the raised perimeter edge 14' define a food-contacting surface 18' comprising the coating 28.

The coating 28 is not applied via an extrusion process. Rather, as previously stated, the coating 28 is preferably press-applied. Typically, a press-applied coating is first applied, via conventional printing press or coating technology, onto a base material in liquid form, and then dried, preferably by heating the resultant coated base material. Alternately, the liquid coating 28 may be cured by cross-linking, as is known in the art. Common cross-linking methods include the application of ultraviolet energy, electron beams, and radio-frequency electromagnetic waves.

The processes preferred for applying the coating 28 include Myer rod, Analox roll, gravure, flexo-graphic, lithographic and off-set printing. Additionally, the liquid coating 28 may be applied by spraying, dipping, painting and electro-plating techniques, or other commercial coating techniques known in the art today.

The preferred method of forming frozen food trays 10, 10' for food having a grease and/or moisture content of at least 75% comprises providing a paper-based substrate 30, applying a grease and/or moisture resistant, liquid coating 28 to the paper-based substrate 30 via a printing press, drying the liquid coating 28 on the paper-based substrate 30, and shaping the paper-based substrate 30 such that it defines at least one recess 12, 12'. Alternately, the liquid coating 28 may be applied to the paper-based substrate 30 after it has been shaped to define the at least one recess 12, 12' and the raised perimeter edge 14, 14'.

The frozen food trays 10, 10' described above may be used for storing and preparing frozen dinners (not shown). A frozen dinner comprises any food, or foods, that remains edible after first being frozen and then heated. The food in the frozen dinner may have a moisture content of 75% or greater. The method of storing and preparing frozen dinners comprises providing frozen food trays 10, 10' as described above, placing a food in the frozen food trays 10, 10', freezing the food in the frozen food trays 10, 10', storing the frozen food trays 10, 10' in a refrigerated environment such that the food remains frozen, removing the frozen food trays 10, 10' from the refrigerated environment, placing the frozen food trays 10, 10' in an oven, and heating the food in the frozen food trays 10, 10'. In a preferred embodiment of the present invention, the frozen dinners comprise a plurality of foods having a moisture content of at least 75%. Furthermore, since the frozen dinners comprise a plurality of foods, the frozen food tray 10 as shown in FIG. 1 is preferred.

Figure 5:
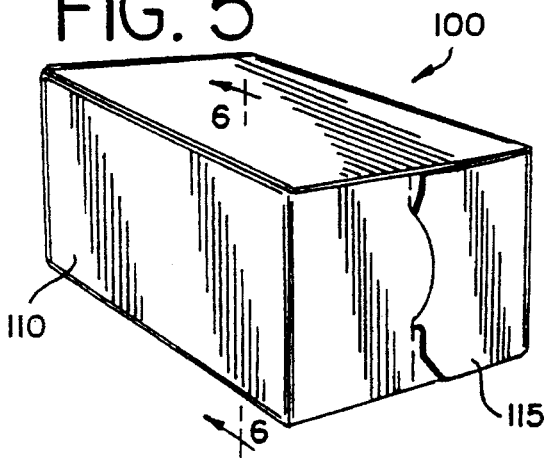
FIG. 5 is a perspective view of a box ice cream container which incorporates a presently preferred embodiment of this invention.
Figure 6:
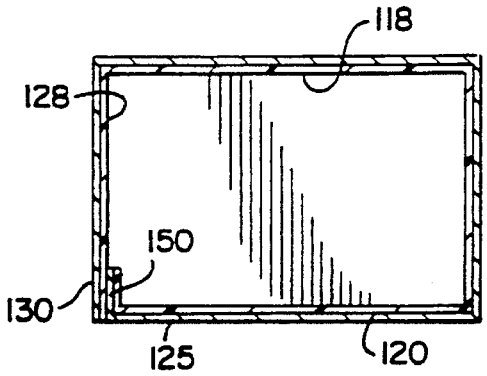
FIG. 6 is a cross-sectional view taken along line 6—6 of FIG. 5.

As shown in FIGS. 5 and 6, a box ice cream container 100 is shaped to define a container portion 110 and a cover 115. The ice cream container is preferably formed from a grease and/or moisture resistant, liquid coating 128 press-applied to a paper-based substrate 130. The inner wall 120 of the paper-based substrate 130 may have a clay coating applied thereto to prevent the liquid coating 128 from soaking into the substrate 130. Alternately, both the inner wall 120 and the outer wall 125 of the paper-based substrate 130 may be clay coated. Preferably, the liquid coating 128 defines the food-contacting surface 118 of the ice cream container 100. The liquid coating 128 remains resistant to grease and/or moisture issuing from the ice cream contained within the container 100 at temperatures in a range of about −20° F. to approximately 68° F. (room temperature).

Figure 9:
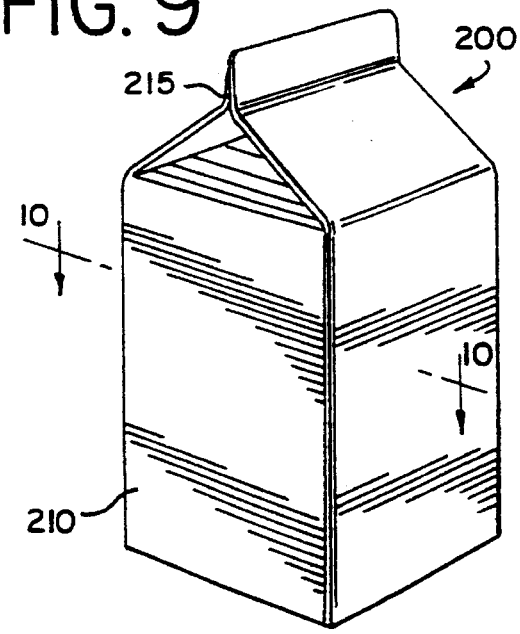
FIG. 9 is a perspective view of a gable top container which incorporates a presently preferred embodiment of the present invention.
Figure 10:
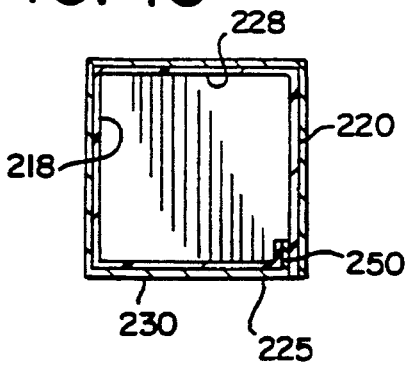
FIG. 10 is a cross-sectional view taken along line 10—10 of FIG. 9.

As shown in FIGS. 9 and 10, a gable top container 200 for milk, juice, cream, egg substitutes and the like is shaped to define a container portion 210, preferably with an openable spout 215. The gable top container 200 is formed from a grease and/or moisture resistant, liquid coating 228 press-applied to a paper-based substrate 230. As with the ice cream container 100, the paper-based substrate 230 of the gable top container 200 may be clay-coated on an inner surface 220 or an outer surface 225, or both. Also, the liquid coating 228 preferably defines the food-contacting surface 218 of the gable top container 200. The liquid coating 228 remains resistant to grease and/or moisture issuing from the food contained within the gable top container 200 at temperatures in a range of about −20° F. to 150° F. The continued grease and/or moisture resistance at elevated temperatures is required because, depending upon the food substance to be placed inside the container 200, gable top containers are often "hot filled."

Figure 7:
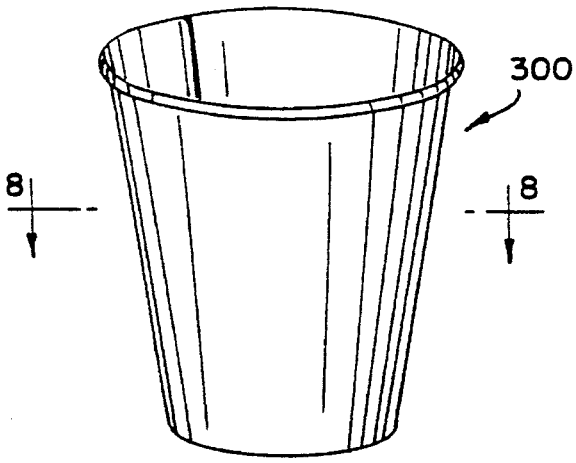
FIG. 7 is a perspective view of a beverage cup which incorporates a presently preferred embodiment of the present invention.
Figure 8:
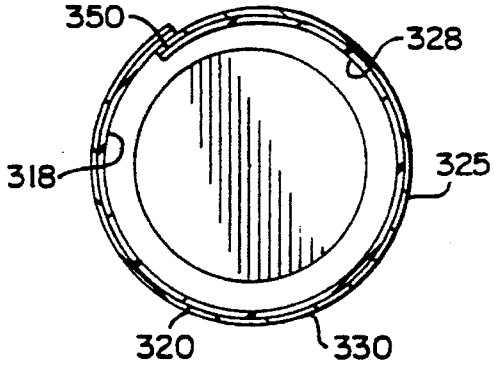
FIG. 8 is a cross-sectional view taken along line 8—8 of FIG. 7.

As shown in FIGS. 7 and 8, a beverage cup 300 for hot or cold beverages and foods (e.g., soups, soft drinks, milkshakes, coffee, tea, ice cream, yogurt) is formed from a grease and/or moisture resistant, liquid coating 328 press-applied to a paper-based substrate 330. As with the ice cream container 100 and the beverage carton 200, the paper-based substrate 330 of the beverage cup 300 may be clay-coated on an inner surface 320 or an outer surface 325, or both. Preferably, the liquid coating 328 defines the food-contacting surface 318 of the beverage cup 300. The liquid coating 328 remains resistant to grease and/or moisture issuing from the beverage contained within the beverage cup 300 at temperatures in a range of about −20° F. to 212° F.

Figure 11:
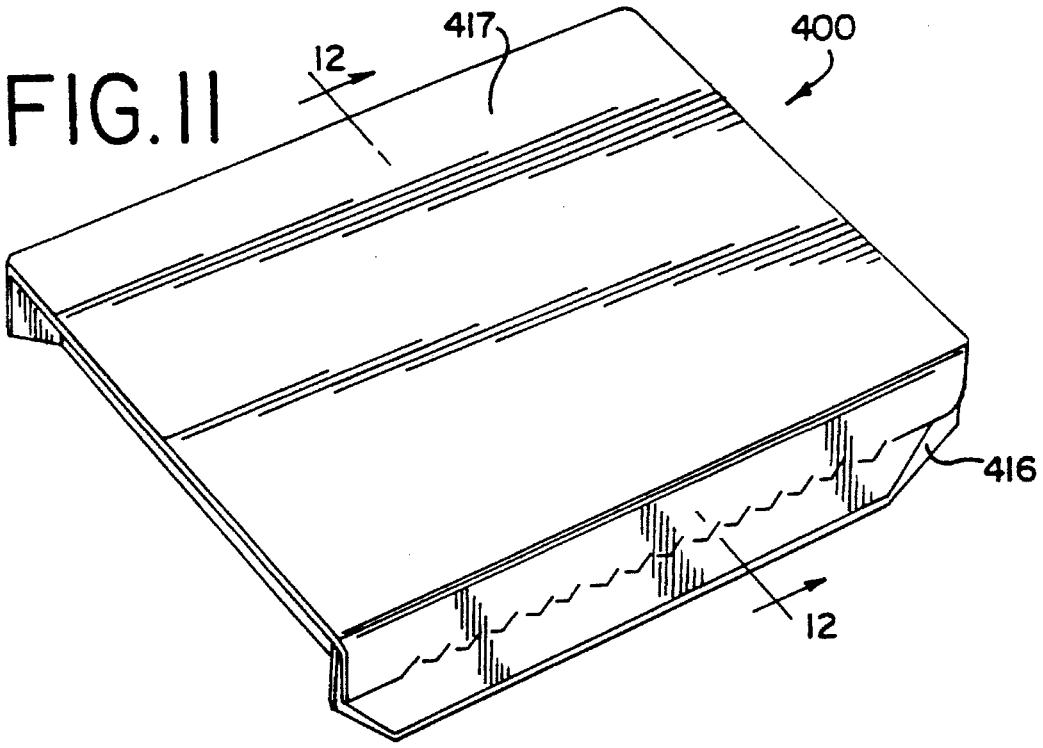
FIG. 11 is a perspective view of a hinged-lid food tray which incorporates a presently preferred embodiment of the present invention.
Figure 12:
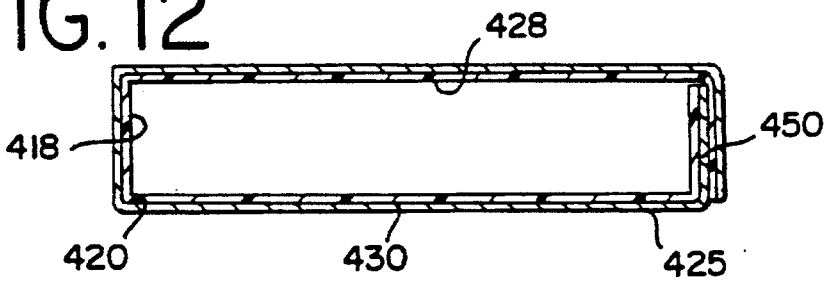
FIG. 12 is a cross-sectional view taken along line 12—12 of FIG. 11.

As shown in FIGS. 11 and 12, a hinged-lid food tray 400 is shaped to define a recess (not shown), a raised perimeter wall 416, and a cover 417. The food tray 400 is preferably formed from a grease and/or moisture resistant, liquid coating 428 press-applied to a paper-based substrate 430. The paper-based substrate 430 of the food tray 400 may be clay-coated on an inner surface 420 or an outer surface 425, or both. The recess and the raised perimeter wall 416, and alternately the cover 417, define a food-contacting surface 418, which preferably comprises the coating 428. The liquid coating 428 remains resistant to grease and/or moisture issuing from the food contained within the food tray 400 at temperatures in a range of about −20° F. to 425° F.

Figure 14:
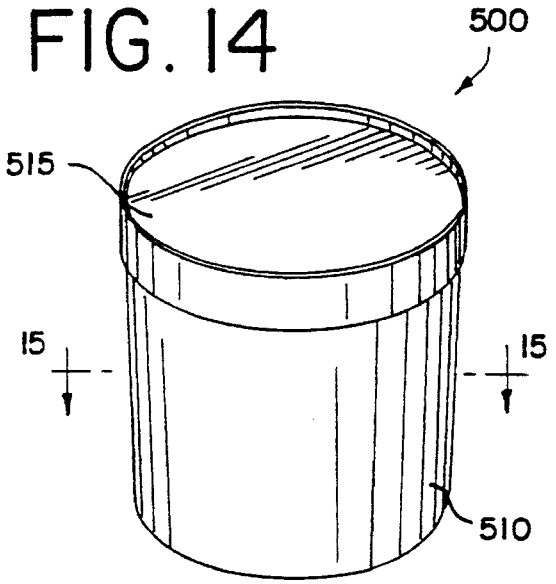
FIG. 14 is a perspective view of a round ice cream container which incorporates a presently preferred embodiment of the present invention.
Figure 15:
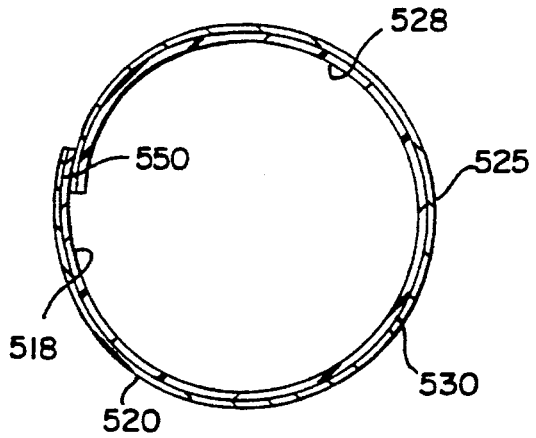
FIG. 15 is a cross-sectional view taken along line 15—15 of FIG. 14.

As shown in FIGS. 14 and 15, a round ice cream container 500 is shaped to define a container portion 510 and a cover 515. The ice cream container 500 is preferably formed from a grease and/or moisture resistant, liquid coating 528 press-applied to a paper-based substrate 530. The inner wall 520 of the paper-based substrate 530 may have a clay coating applied thereto to prevent the liquid coating 528 from soaking into the substrate 530. Alternately, both the inner wall 520 and the outer wall 525 of the paper-based substrate 530 may be clay coated. Preferably, the liquid coating 528 defines the food-contacting surface 518 of the ice cream container 500. The liquid coating 528 remains resistant to grease and/or moisture issuing from the ice cream contained within the container 500 at temperatures in a range of about −20° F. to approximately 68° F. (room temperature).

Figure 16:
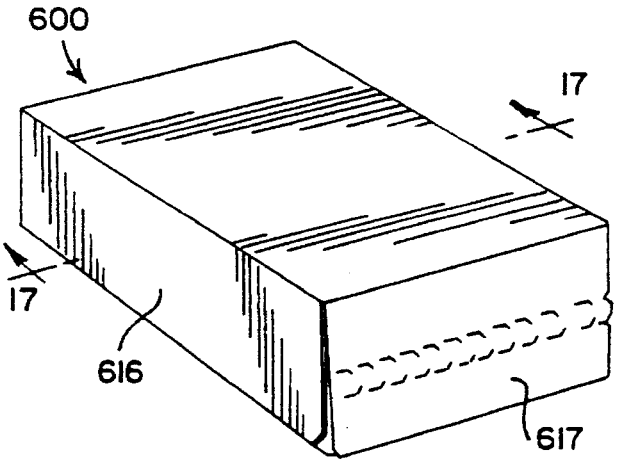
FIG. 16 is a perspective view of a food carton which incorporates a presently preferred embodiment of the present invention.
Figure 17:
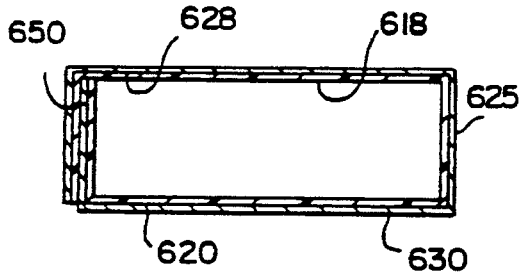
FIG. 17 is a cross-sectional view taken along line 17—17 of FIG. 16.

As shown in FIGS. 16 and 17, a food carton 600 is shaped to define a recess (not shown), a raised perimeter wall 616, and a cover 617. The food carton 600 is preferably formed from a grease and/or moisture resistant, liquid coating 628 press-applied to a paper-based substrate 630. The paper-based substrate 630 of the food carton 600 may be clay-coated on an inner surface 620 or an outer surface 625, or both. The recess and the raised perimeter wall 616, and alternately the cover 617, define a food-contacting surface 618, which preferably comprises the coating 628. The liquid coating 628 remains resistant to grease and/or moisture issuing from the food contained within the food tray 600 at temperatures in a range of about −20° F. to 425° F.

Figure 18:
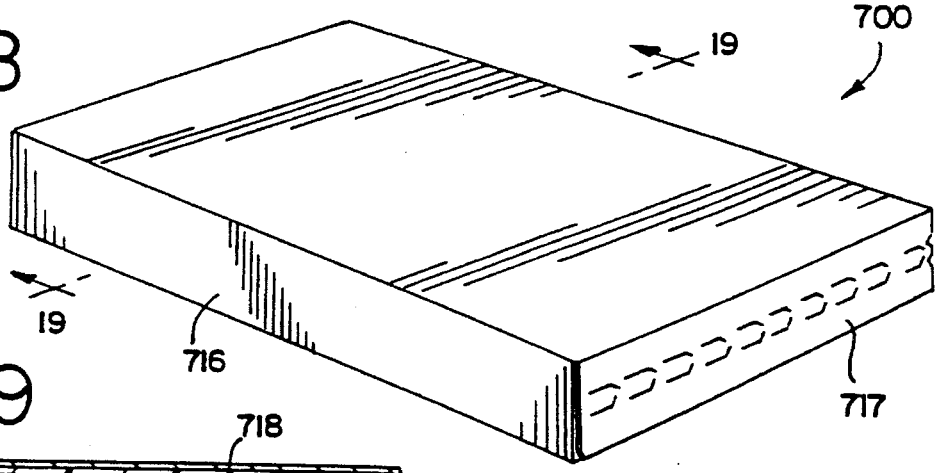
FIG. 18 is a perspective view of an alternate embodiment of a food carton which incorporates a presently preferred embodiment of the present invention.
Figure 19:
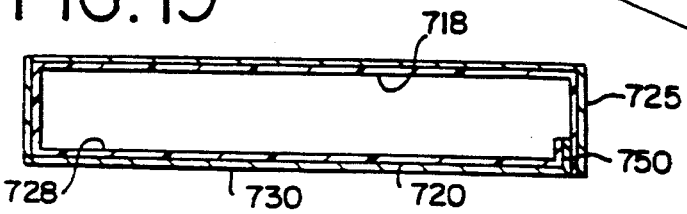
FIG. 19 is a cross-sectional view taken along line 19—19 of FIG. 18.

Lastly, as shown in FIGS. 18 and 19, an alternate embodiment of a food carton 700 is shaped to define a recess (not shown), a raised perimeter wall 716, and a cover 717. The food carton 700 is preferably formed from a grease and/or moisture resistant, liquid coating 728 press-applied to a paper-based substrate 730. The paper-based substrate 730 of the food carton 700 may be clay-coated on an inner surface 720 or an outer surface 725, or both. The recess and the raised perimeter wall 716, and alternately the cover 717, define a food-contacting surface 718, which preferably comprises the coating 728. The liquid coating 728 remains resistant to grease and/or moisture issuing from the food contained within the food tray 700 at temperatures in a range of about −20° F. to 425° F.

The beverage cup 300 and the round ice cream container 500 are preferably formed by forming a liquid-coated, paper-based blank around a mandrel, and heat-sealing the overlapping portion of the blank to itself. Next, the bottom portion of the containers 300, 500 is connected to the blank, as is known in the art. Usually, the top edge of the blank is rolled to provide a finished look or to accommodate a snap-on lid.

The box ice cream container 100, the gable top container 200, and the food cartons 600, 700 are preferably formed by cutting and folding a paper-based blank in the desired locations, and gluing or heat-sealing the folded portions of the blank, as is known in the art.

The hinged-lid food tray 400 is preferably formed in the same manner as are the frozen food trays 10, 10'.

The liquid coatings 128, 228, 328, 428, 528, 628, 728 utilized in the box ice cream container 100, the gable top container 200, the beverage cup 300, the food tray 400, the round ice cream container 500, and the food cartons 600, 700 described above may be formed from the same materials as is the liquid coating 28 used in forming the frozen food trays 10, 10'. Indeed, the liquid coatings 128, 228, 328, 428, 528, 628, 728 have the same characteristics and may be applied in the same manner as the liquid coating 28.

Additionally, the box ice cream container 100, the gable top container 200, the beverage cup 300, the food tray 400, the round ice cream container 500, and the food cartons 600, 700 described above may have multiple coatings placed atop their respective substrates 130, 230, 330, 430, 530, 630, 730, as does the alternate embodiment of the frozen food tray 10 depicted in FIG. 3. Also, the ice cream container 100, the gable top container 200, the beverage cup 300, the food tray 400, the round ice cream container 500, and the food cartons 600, 700 may be formed in essentially the same manner as are the frozen food trays 10, 10'.

The following materials may be suitable for use in the preferred embodiment of the invention: the paper-based substrates 30, 130, 230, 330, 430, 530, 630, 730 may be formed of #1206 clay-coated (one side) cup stock, 0.018" to 0.024" thick, supplied by James River; and the grease and/or moisture resistant, liquid coatings 28, 128, 228, 328, 428, 528, 628, 728 may be Santel HR-62 supplied by ADM Tronics, which is acrylic-based.

In alternative embodiments of the present invention, the paper-based substrates 30, 130, 230, 330, 430, 530, 630, 730 and the liquid coatings 28, 128, 228, 328, 428, 528, 628, 728 may be comprised of a variety of types or grades of the materials described above, or they may be provided with other chemical treatments or coatings in order to create different barrier effects. Specifically, the paper-based substrates 30, 130, 230, 330, 430, 530, 630, 730 can be made from various grades of paperboard or molded paper pulp, and the substrates 30, 130, 230, 330, 430, 530, 630, 730 may be chemically treated or clay coated to provide for various barrier effects or printed surfaces. Additionally, the liquid coatings 28, 128, 228, 328, 428, 528, 628, 728 may either be aqueous-based or solvent-based, and may have any dry basis weight suitable for the application. Furthermore, the frozen food trays 10, 10' may be press-formed trays, gausetted-corner trays, folded-corner trays, hinged/lidded tray assemblies or molded pulp trays.

Additionally, some of the coating materials described above may have the advantage of being recyclable, even after being applied to a paper-based substrate.

Furthermore, in situations where the liquid-coated substrates 30, 130, 230, 330, 430, 530, 630, 730 overlap (i.e., at points labeled 150, 250 350, 450, 550, 650, 750 in the Figures), the liquid coatings 28, 128, 228, 328, 428, 528, 628, 728 may be able to be heat sealed to themselves or to the substrates. Alternately, a heat sealable material may be placed atop the liquid coatings 28, 128, 228, 328, 428, 528, 628, 728 or atop the substrates 30, 130, 230, 330, 430, 530, 630, 730 in the specific area where the substrates 30, 130, 230, 330, 430, 530, 630, 730 will overlap to provide heat sealability.

The frozen food trays 10, 10' described above are ovenable in both conventional ovens and microwave ovens.

An example of forming a liquid coating and applying it to a paper-based substrate is described below. First, place monomers of acrylic esters in water and add a catalyst, e.g. potassium persulfate, to polymerize the acrylic esters in the aqueous solution. Then coat a paper-based substrate with the liquid coating via the Myer rod or Analox roll technique, as is commonly known in the art. (Alternately, the paper-based substrate is printed via the flexo-graphic or gravure printing technique.) The water in the coating is driven off, and the coating is dried, by placing the paper-based substrate in a Faustel air oven.

It should be appreciated that the food containers of this invention may be shaped and coated as appropriate for the application. The embodiments described above are to be considered in all respects only as illustrative and not restrictive. The scope of the invention is indicated by the following claims rather than by the foregoing description. All changes which come within the meaning and range of equivalency of the claims are to be embraced within their scope.

What is claimed is:

1. A package for food having a moisture content of at least 75% comprising:

a) a paper-based substrate; and b) at least one grease and moisture resistant, liquid coating press-applied to said paper-based substrate, said coating comprising an aqueous-based dispersion including an acrylic-based material to define a food-contacting surface of the package having a dry basis weight in a range of about 0.1 to 5 lbs./1000 $ft^2$.

2. An ovenable frozen food tray of food having a moisture content of at least 75% comprising:

a) a paper-based substrate; and b) at least one grease and moisture resistant, liquid coating press-applied to said paper-based substrate, said coating comprising an aqueous-based dispersion including an acrylic-based material to define a food-contacting surface of said frozen food tray having a dry basis weight in a range of about 0.1 to 5 lbs./1000 $ft^2$, said frozen food tray shaped to define at least one recess and a raised perimeter edge.

3. A method of forming an ovenable frozen food tray for food having a moisture content of at least 75%, comprising the following steps:

a) providing a paper-based substrate;

b) applying at least one grease and moisture resistant, liquid coating to the paper-based substrate via a printing press, said coating comprising an aqueous-based dispersion including an acrylic-based material to define a food contacting surface of the frozen food tray;

c) drying said liquid coating on the paper-based substrate to form a grease and moisture resistant, liquid coating having a dry basis weight in a range of about 0.1 to 5 lbs./1000 $ft^2$; and d) shaping the paper-based substrate such that it defines at least one recess and a raised perimeter edge.

4. A composite container for food comprising a container formed of a paper-based substrate having a press-applied, grease and moisture resistant coating defining a food-contacting surface, the coating applied to the substrate as an aqueous dispersion of an acrylic coating material, then dried so that the thus formed coating has a dry basis weight in the range of from about 0.1 to 5 lbs./1000 $ft^2$.

5. A composite container for food comprising a container formed of a paper-based substrate having a coating defining a food-contacting surface, the coating applied to the substrate as an aqueous dispersion of an acrylic coating material, then dried so that the thus formed coating has a dry basis weight in the range of from about 0.1 to 5 lbs./1000 $ft^2$.

6. The container of claim 5 wherein the coating is grease or moisture resistant.

7. The container of claim 6 wherein the coating is grease and moisture resistant.

8. The container of claim 5 wherein the coating is heat sealable.

9. The container of claim 5 wherein the coating is press-applied.

10. The container of claim 9 wherein the container is selected from cups, ovenable food trays, hinged-lid food trays, ice cream cartons, and gable top cartons.

11. The container of claim 10 wherein the container is an ovenable frozen food tray.

12. The container of claim 11 wherein the coating is grease or moisture resistant in a range of from about −20° F. to 425° F.

13. The container of claim 12 further comprising the container has a raised perimeter edge defining a recess.

14. The container of claim 13 further comprising the container has a raised internal ridge dividing the recess into a plurality of compartments.

15. A packaged foodstuff comprising a foodstuff having a moisture content of at least 75% packaged in a composite container, the container formed of a paper-based substrate having a press-applied, grease and moisture resistant coating defining a food-contacting surface, the coating applied to the substrate as an aqueous dispersion of an acrylic coating material, then dried so that the thus formed coating has a dry basis weight in the range of from about 0.1 to 5 lbs./1000 $ft^2$.

16. The packaged foodstuff of claim 15 wherein the coating is heat sealable.

17. The packaged foodstuff of claim 15 wherein the container is selected from cups, ovenable food trays, hinged-lid food trays, ice cream cartons, and gable top cartons.

18. The packaged foodstuff of claim 17 wherein the container is an ovenable frozen food tray.

19. The of packaged foodstuff claim 18 wherein the coating is grease or moisture resistant in a range of from about −20° F. to 425° F.

20. The packaged foodstuff of claim 19 further comprising the container has a raised perimeter edge defining at least one recess.

21. The packaged foodstuff of claim 20 further comprising the container has a raised internal ridge dividing the recess into a plurality of compartments.

22. A process of forming a composite food container comprising the following steps:

a) providing a paper-based blank;

b) press-applying an aqueous dispersion of a grease and moisture resistant acrylate coating material to the paper-based blank;

c) drying the coating material to form a grease and moisture resistant coating having a dry basis weight in the range of about 0.1 to 5 lbs./1000 $ft^2$ on the paper-based blank; and d) shaping the thus coated blank to form a food container having a coated food-contacting surface.

23. The process of claim 22 wherein the coating is heat sealable.

24. The process of claim 22 wherein the blank is shaped into a cup, an ovenable food tray, a hinged-lid food tray, an ice cream carton, or a gable top carton.

25. The process of claim 24 wherein the blank is shaped into an ovenable frozen food tray.

26. The process of claim 25 wherein the coating is grease or moisture resistant in a range of from about −20° F. to 425° F.

27. The process of claim 26 further comprising the container is shaped to form a raised perimeter edge defining a recess.

28. The process of claim 27 further comprising the container is shaped to form a raised internal ridge dividing the recess into a plurality of compartments.

* * * * *

UNITED STATES PATENT AND TRADEMARK OFFICE

CERTIFICATE OF CORRECTION

PATENT NO. : 5,573,693

DATED : November 12, 1996

INVENTOR(S) : Lorence et al.

It is certified that error appears in the above-indentified patent and that said Letters Patent is hereby corrected as shown below: The title page, should read as follows, item

[75] Inventors: Matthew W. Lorence; David H. Scherpf; Brian D. Hopkins, all of Omaha, Nebr.

Signed and Sealed this

Ninth Day of September, 1997

*Attest:*

Bruce Lehman

BRUCE LEHMAN

*Attesting Officer*

*Commissioner of Patents and Trademarks*